US005536421A

United States Patent [19]

Hartman et al.

[11] Patent Number: 5,536,421

[45] Date of Patent: Jul. 16, 1996

[54] METHOD FOR USING SOLID PARTICULATE FABRIC SOFTENER IN AUTOMATIC DOSING DISPENSER

[75] Inventors: Frederick A. Hartman; John R. Rusche, both of Cincinnati; Lucille F. Taylor, Middletown, all of Ohio

[73] Assignee: The Procter & Gamble Company, Cincinnati, Ohio

[21] Appl. No.: 261,317

[22] Filed: Jun. 16, 1994

Related U.S. Application Data

[63] Continuation of Ser. No. 952,430, Sep. 28, 1992, abandoned.

[51] Int. Cl.[6] ..... D06M 13/325

[52] U.S. Cl. ..... 8/137; 510/517; 510/521

[58] Field of Search ..... 252/8.6, 8.8, 8.9, 252/547, 174.21

[56] References Cited

U.S. PATENT DOCUMENTS

| | | | |
|---|---|---|---|
| T993,001 | 4/1980 | McCarthy | 68/17 R |
| 3,108,722 | 10/1963 | Torongo, Jr. et al. | 222/163 |
| 3,256,180 | 6/1966 | Weiss | 252/8.8 |
| 3,351,483 | 11/1967 | Miner et al. | 117/66 |
| 3,492,324 | 1/1970 | Blackman | 260/404.5 |
| 3,793,196 | 2/1974 | Okazaki et al. | 252/8.8 |
| 3,888,391 | 6/1975 | Merz | 222/52 |
| 4,126,562 | 11/1978 | Goffinet et al. | 252/8.8 |
| 4,128,484 | 12/1978 | Barford et al. | 252/8.8 |
| 4,137,180 | 1/1979 | Naik et al. | 252/8.8 |
| 4,151,097 | 4/1979 | Nelson | 252/8.6 |
| 4,152,272 | 5/1979 | Young | 252/8.8 |
| 4,259,373 | 3/1981 | Demessemaekers et al. | 427/242 |
| 4,264,457 | 4/1981 | Beeks et al. | 252/8.75 |
| 4,268,401 | 5/1981 | Meschkat et al. | 252/8.8 |
| 4,308,151 | 12/1981 | Cambre | 252/8.8 |
| 4,328,110 | 5/1982 | Green | 252/8.75 |
| 4,395,342 | 7/1983 | Strauss | 252/8.8 |
| 4,443,363 | 4/1984 | Klinger et al. | 252/547 |
| 4,589,989 | 5/1986 | Muller et al. | 252/8.75 |
| 4,767,547 | 8/1988 | Straathof et al. | 252/8.8 |
| 4,846,982 | 7/1989 | Madore et al. | 252/8.75 |
| 4,970,028 | 11/1990 | Kenyon et al. | 252/544 |
| 5,009,800 | 4/1991 | Foster | 252/8.9 |
| 5,066,414 | 11/1991 | Chang | 252/8.8 |
| 5,185,088 | 2/1993 | Hartman | 252/8.6 |
| 5,200,097 | 4/1993 | Hughes et al. | 252/8.75 |
| 5,368,755 | 11/1994 | Chavez et al. | 252/8.6 |

FOREIGN PATENT DOCUMENTS

| | | | |
|---|---|---|---|
| 0339198 | 11/1989 | European Pat. Off. | D06F 2/39 |
| 523287 | 1/1993 | European Pat. Off. . | |
| 547723 | 6/1993 | European Pat. Off. . | |
| 568297 | 11/1993 | European Pat. Off. . | |
| 569184 | 11/1993 | European Pat. Off. . | |
| 270638 | 8/1989 | Germany . | |
| WO88/00990 | 2/1988 | WIPO | D06M 13/46 |

OTHER PUBLICATIONS

U.S. Ser. No. 07/689,406 Hartman et al filed Apr. 22, 1991.
U.S. Ser. No. 07/851,581 Baginski filed Mar. 16, 1992.
U.S. Ser. No. 07/881,979 Baker et al filed May 12, 1992.

*Primary Examiner*—Paul Lieberman
*Assistant Examiner*—Michael P. Tierney
*Attorney, Agent, or Firm*—Robert B. Aylor

[57] ABSTRACT

A method of softening fabrics where the consumer adds an effective amount of a particulate fabric softening composition comprising fabric softener agent to an automatic dosing dispenser with water, seals the dispenser, and places the automatic dosing dispenser into a washing machine at the beginning of the wash process. The mechanical agitation and/or heat of the wash cycle aids in forming a finely divided emulsion/dispersion of fabric softener agent which is then released from the dispenser during the rinse cycle.

24 Claims, No Drawings

METHOD FOR USING SOLID PARTICULATE FABRIC SOFTENER IN AUTOMATIC DOSING DISPENSER

This is a continuation of application Ser. No. 07/952,430, filed on Sep. 28, 1992, now abandoned.

BACKGROUND OF THE INVENTION

This invention relates to a method of softening fabrics during the rinse cycle of a typical wash process.

It has long been recognized that certain chemical compounds have the capability of imparting softness to textile fabrics. These compounds, which are known generally as "softening agents," "fabric softeners," or "softeners," have been used in the laundry to soften a finished fabric, thereby making the fabric smooth, pliable and fluffy to handle. In addition to the quality of softness, the fabrics frequently have a reduced tendency to static cling and are easier to iron.

A basic distinction can be made between a rinse cycle softener and a wash cycle softener. A typical wash cycle fabric softener usually constitutes solid particles of a quaternary ammonium compound and is mixed with a powder laundry detergent or added at the same time as the laundry detergent, usually before initiation of the wash cycle of the washing machine. Such a composition is convenient since it does not require a dispenser on the washing machine and the composition can be packaged in cheaper, more biodegradable, packages. However, wash-added softeners tend to be less effective than rinse-added softener compositions.

On the other hand, a rinse cycle softener is usually a liquid dispersion which is added to the rinse liquor during the rinse cycle. These liquid dispersions can be manufactured as such or can be formed by adding water to solid particulate softener compositions. A liquid product containing a small particle size dispersion/emulsion tends to more effectively cover the laundry fabrics. Although solid particulate fabric softeners can be added directly to, e.g., rinse liquor to form a dilute treatment bath for fabrics, the solid compositions are usually more effective when an aqueous concentrate is formed prior to addition to the rinse cycle. At low water temperatures, it can take up to fifteen minutes to form the desired, more effective, small particle size emulsion/dispersion. Fifteen minutes is typically longer than the rinse cycle in an ordinary automatic laundry machine. The present invention provides a way to obtain both the advantages of better efficacy of a liquid rinse-added softener composition and of packaging benefits of a solid softener composition while eliminating the steps needed to form an intermediate aqueous concentrate.

The softening agents which are usually employed in compositions intended for use by the individual consumer are cationic surfactant compounds. Historically, these were quaternary ammonium compounds having at least two long alkyl chains, for example, distearyl dimethyl ammonium chloride. The positive charge on the softening compound encourages its deposition onto the fabric substrate, the surface of which is usually negatively charged.

Although the above-mentioned cationic compounds are highly effective softeners when applied in a rinse solution, it is difficult to supply the traditional cationic softeners in a granular form which will readily disperse to form concentrated, finely divided, aqueous emulsions/dispersions having a concentration of from about 5% to about 30% of softener active. Cationic granule compounds having long alkyl chains tend to form highly viscous/non-dispersible phases rather than dispersions when added to water. However, by mixing certain granular nonionic softeners, or mixtures of nonionic softeners or cationics, with tap water, the consumer can form aqueous concentrated emulsions/dispersions of the type used by individual consumers. These compositions provide excellent deposition onto the fabric surface from dilute aqueous solution. The compositions are sold in granular form and used by the consumer to form typical aqueous, liquid, rinse-added fabric softener compositions of the general type disclosed in U.S. Pat. Nos.: 4,128,484, Barford and Benjamin, for Fabric Softening Compositions, issued Dec. 5, 1978; and U.S. Pat. No. 4,126,562, Golfinet and Leclercq, for Textile Treatment Compositions, issued Nov. 21, 1978; said patents being incorporated herein by reference.

Granular compositions and method of utilizing them provide a large environmental advantage versus existing liquid products since the granular products can be packaged in cardboard cartons that are essentially biodegradable rather than in plastic bottles which are more slowly degraded.

OBJECT OF THE INVENTION

The object of the present invention is to develop a method of adding fabric softener to the rinse liquor with added convenience to the consumer. In addition the object of the invention is to develop a method of utilizing a particulate, e.g., granular fabric softening composition to achieve similar efficacy to liquid softeners while providing economical and/or environmental advantages over existing liquid softeners. These environmental advantages include reduced package size, the use of alternate packaging materials such as cardboard rather than plastic, and minimizing solid waste, cost, and fuel/energy associated with production and disposal of larger plastic bottles.

SUMMARY OF THE INVENTION

The present invention relates to a method of softening fabrics where the consumer adds a particulate fabric softening composition, especially compositions that are easily dispersed in water as described hereinafter, to an automatic dosing dispenser (ADD) (especially as described hereinafter) with water and places the- automatic dosing dispenser into a typical U.S. top-loading washing machine at the beginning of the wash process. In particular the consumer adds an amount of particulate fabric softener composition to an automatic dosing dispenser with water, manually secures or seats the dispenser valve, and places the dispenser into the washing machine at the beginning of the wash cycle. The mechanical agitation of the wash cycle assists in the formation of an aqueous dispersion, preferably a finely divided emulsion/dispersion, of the fabric softener which is then released during the rinse cycle. With this process, the steps necessary to manually prepare a liquid product from the solid softener composition before use and to "catch the rinse cycle" to deliver the product at the appropriate time, have been eliminated.

According to the invention, the fabric softening agent can be any fabric softener which can be formed into particles, e.g., granulated and which will form an effective aqueous emulsion/dispersion, when added to water, within about 30 minutes. According to preferred aspects of the present invention, a method of forming a liquid softening composition is provided in which granules, when added to water in an ADD, inherently form an aqueous emulsion/dispersion, where the particles of the dispersed phase preferably are characterized by an average particle size of less than about 5 microns in diameter. Preferred fabric softening compositions are the compositions disclosed in U.S. patent application Ser. No. 07/689,406, F. A. Hartman, D. R. Brown, J. R. Rusche, L. F. Taylor, filed Apr. 22, 1991, said application being incorporated herein by reference.

Other preferred solid softener compositions for use in the present invention are disclosed in commonly assigned, copending U.S. patent application Ser. No. 07/881,979, Baker et al., filed May 12, 1992, specifically on page 4 (starting on line 16) through page 8; page 10 (starting on line 10) to page 36 (lines 1–14); especially pages 33 (starting on line 4) to page 36 (lines 1–14); and Example VIII on pages 50–52, said application being incorporated herein by reference.

DETAILED DESCRIPTION OF THE INVENTION

The method of the present invention utilizes compositions which comprise components which are described more fully hereinafter.

Preparation and Usage

The consumer adds an effective amount of the particulate fabric softening composition, described in detail hereinafter, to an automatic dosing dispenser of the type herein described with an effective amount of water. An "effective amount" of particulate fabric softening composition means an amount sufficient to condition an average load of fabrics in an automatic washing machine. The actual amount of particulate fabric softener composition employed depends on the fabric load, the particulate fabric softener composition selected, and/or the amount of active fabric softener material in the composition selected. For an average load (5 lbs. to 8 lbs.) of fabrics, from about 2 gms to. about 20 gms, preferably from about 4 gms to about 10 gms, of any of the foregoing particulate softener compositions provide good fabric conditioning.

An "effective amount" of water means an amount that will form, with the particulate fabric softener, an aqueous emulsion/dispersion within about 30 minutes. Two gms to 20 gms of any of the foregoing preferred particulate softener compositions requires from about 20 cc to about 100 cc of water. The resulting concentration of the liquid softener composition is from about 2% to about 30%, preferably from about 5% to about 15%. The water temperature is from about 20° C. to about 90° C., preferably from about 35° C. to about 45° C. If desired, the ADD can be agitated from about 1 to about 30 minutes, preferably from about 1 to about 5 minutes, prior to placing the ADD in the wash basket. Preferably, the solid is added to the ADD first before the water so that any particulate fabric softening composition which deposits on the ADD seal valve will be washed down into the ADD with the addition of the water.

After filling the automatic dosing dispenser, the consumer manually seats the valve at the opening.

The consumer then places the automatic dosing dispenser into the washing machine basket with fabrics and a normal amount of detergent, at the beginning of the wash cycle. Thereafter, the consumer operates the washing machine at normal operating conditions through the wash, rinse, and spin dry cycles. An aqueous dispersion forms in the ADD through the mechanical agitation and/or heat provided by the wash cycle. Preferably this aqueous dispersion is a finely divided emulsion/dispersion.

The automatic dosing dispenser releases the resulting aqueous emulsion/dispersion fabric softener composition during the rinse cycle as hereafter described.

The granular compositions are desirably packaged in cardboard boxes, but it can be desirable to add one, or more, liquid/vapor barrier laminate to the cardboard. Preferably the package carries instructions for adding the composition to the ADD to practice the process set forth hereinbefore.

Normally, the preferred granules containing the softening agents, described hereinbefore and hereinafter, readily form true concentrated emulsions/dispersions before the rinse cycle with an aqueous continuous phase when added to water in the ADD. The temperature of the water can vary from about 20° C. to about 90° C., preferably from about 35° C. to about 45° C. The resulting disperse phase can be wholly or partially solid, so that the final aqueous liquid composition can exist as a dispersion which is not a true liquid/liquid emulsion. It will be understood that the term "dispersion", as used herein, means liquid/liquid phase or solid/liquid phase dispersions and/or emulsions.

For normal use as rinse-added aqueous liquid compositions, the disperse phase, provided by the granules, comprises from about 2% to about 30%, preferably from about 5% to about 15%, of the aqueous composition. The resulting aqueous compositions of the present invention are used to provide an active concentration in the rinse water of from about 0.003 to about 0.1%, preferably from about 0.005% to about 0.05% (an effective concentration of active softening agent of from about 30 to about 1,000 ppm, preferably from about 50 to about 500 ppm).

Automatic Dosing Dispenser

Various designs of "free body" automatic laundry additive dispensers are disclosed in the prior art. "Free body" dispensers are those which are not physically attached to the washing machine. Generally, these "free body" automatic dosing dispensers are triggered during the first spin cycle of the washing process. After the wash cycle, water drains from the basket and the machine goes through the first spin cycle. Centrifugal force generated by the spinning wash basket triggers the dispenser by opening a valve to allow later discharge of the additive from the dispenser. At the conclusion of the spin cycle the wash basket stops spinning and the machine begins the rinse cycle. During the rinse cycle, water flows into the ADD and disperses the additive into the rinse water. Examples of such devices include U.S. Pat. No. 3,888,391, Merz, issued on Jun. 10, 1975; U.S. Pat. No. 3,108,722, Torongo et al., issued Oct. 29, 1963; and U.S. Defensive Pub. No. T993,001, McCarthy, published Apr. 1, 1980, all of which are hereby incorporated herein by reference.

The Merz patent shows a free body dispenser having a hollow spherical container with a single orifice and a weighted stem. There is also provided a cylindrical tube, the proximal end of which is attached to the orifice. The distal end of the tube, which projects into the interior of the container, is provided with a valve seat which is adapted to seat a manually sealable centrifugally openable valve. Extending through this valve is an L-shaped stempiece with a mass attached thereto. When the valve is seated, the mass is positioned within the interior of the container.

The Torongo et al. patent relates to a spherical free body dispenser which includes two valved and oppositely disposed orifices. A flexible stempiece extends between the valves and has a mass centrally disposed thereon. When the valves are seated, the stempiece is fairly taut and the mass is centrally disposed within the container portion of the dispenser.

The McCarthy publication discloses a dispenser comprising an assemblage of three major elements: a hollow, spherical container provided with an orifice; a resilient valve seated within the orifice and a rigid stempiece extending axially through the valve. The valve is positioned on the stempiece so that when seated a portion of the stempiece protrudes outwardly beyond the exterior of the container. A mass is attached to the interior end of the stempiece.

A particularly preferred dispenser which can be employed in the practice of the present invention is disclosed in commonly assigned, copending U.S. patent application Ser. No. 07/851,581, Baginski et al., filed Mar. 16, 1992, entitled "Improved Method and Apparatus for Dispensing Rinse Water Additive in an Automatic Washing Machine," the disclosure only of which is incorporated herein by reference, specifically page 4 (starting on line 8) through page 14, FIGS. 1–3 of the drawings, and especially the summary of the invention on page 4 (starting on line 8) to page 6 (lines 1–8).

In each of the above-mentioned devices, valve triggering is caused by centrifugal force generated during the spin cycle acting upon the the mass attached to the stempiece or upon the portion of the stempiece protruding outwardly beyond the exterior of the container as in the McCarthy publication.

Solid Particulate Fabric Softener Compositions

The preferred particulate fabric softener compositions useful herein are selected from the group consisting of:

I. a solid particulate composition comprising:

(A) from about 50% to about 95% of biodegradable diester quaternary ammonium fabric softening compound; and (B) from about 3% to about 30% of viscosity and/or dispersibility modifier selected from the group consisting of:

1. single-long-chain-alkyl, cationic surfactant;
2. nonionic surfactant with at least 8 ethoxy moieties; or
3. mixtures thereof; and II. a solid particulate composition comprising:

(A) from about 20% to about 95% of nonionic fabric softener material; and (B) from about 5% to about 50% of a material that is cationic under conditions of use at dilute concentrations of said composition, said cationic material having a single long alkyl chain containing from about 12 to about 30 carbon atoms.

These preferred particulate fabric softener compositions are readily dispersed in water to form effective small particle size dispersions.

I. Solid Compositions Having Diester Quaternary Compound and Viscosity Modifier (1) Solid compositions containing biodegradable diester quaternary ammonium fabric softening compounds which contain either single long chain quaternary ammonium compounds, especially ones that also contain an ester linkage, or (2) specific relatively highly ethoxylated nonionic surfactants, or (3) mixtures of these, provide and maintain concentrated aqueous compositions at low viscosities and/or with improved dispersibility. Several materials, as discussed hereinafter, including, e.g., substantially linear fatty acid and/or fatty alcohol monoesters in any diester quaternary ammonium compound premix, described in detail hereinafter in section (C), which is used to prepare said concentrated fabric softener composition, will improve fluidity, either alone, or in combination with (B).

The compositions, when prepared as particulate solids, contain from about 50% to about 95%, preferably from about 60% to about 90%, of said softening compound.

(A) Diester Quaternary Ammonium Compound (DEQA)

One preferred particulate composition (I) of the present invention contains from about 50% to about 95%, preferably from about 60% to about 90%, of said diester quaternary ammonium fabric softening compound (DEQA), preferably having the formula:

$$(R)_{4-m}—N\oplus—[(CH_2)_n—Y—R^2]_m\ X\theta$$

wherein each Y=—O—(O)C—, or —C(O)—O—;

m=2 or 3;

each n=1 to 4;

each R substituent is a short chain $C_1$–$C_6$, preferably $C_1$–$C_3$ alkyl or hydroxyalkyl group, e.g., methyl (most preferred), ethyl, propyl, hydroxyethyl, and the like benzyl or mixtures thereof; each $R^2$ is a long chain $C_{12}$–$C_{22}$ hydrocarbyl, or substituted hydrocarbyl substituent, preferably $C_{15}$–$C_{19}$ alkyl and/or alkylene, most preferably $C_{15}$–$C_{17}$ straight chain alkyl and/or alkylene; and the counterion, $X^-$, can be any softener-compatible anion, for example, chloride, bromide, methylsulfate, formate, sulfate, nitrate and the like.

It will be understood that substituents R and $R^2$ can optionally be substituted with various groups such as alkoxyl or hydroxyl groups, and/or can be saturated, unsaturated, straight, and/or branched so long as the $R^2$ groups maintain their basically hydrophobic character. The preferred compounds can be considered to be diester variations of disallow dimethyl ammonium chloride (DTDMAC), which is a widely used fabric softener. At least 80% of the DEQA is in the diester form, and from 0% to about 20% can be DEQA monoester (e.g., only one —Y—$R^2$ group).

As used herein, when the diester is specified, it will include the monoester that is normally present, but not additional monoester that is added. For softening, the percentage of diester should be as high as possible, preferably more than 90%.

The above DEQA compounds used as the primary active softener ingredient in the practice of this aspect of the invention can be prepared using standard reaction chemistry. In one synthesis of a di-ester variation of DTDMAC, an amine of the formula $RN(CH_2CH_2OH)_2$ is esterified at both hydroxyl groups with an acid chloride of the formula $R^2C(O)Cl$, then quaternized with an alkyl halide, RX, to yield the desired reaction product (wherein R and $R^2$ are as defined hereinbefore). A method for the synthesis of a preferred di-ester softening compound is disclosed in detail hereinafter. However, it will be appreciated by those skilled in the chemical arts that this reaction sequence allows a broad selection of compounds to be prepared. The following are nonlimiting examples (wherein all long-chain alkyl substituents are straight-chain):

$[HO—CH(CH_3)CH_2][CH_3]^{\oplus}\ {}^{N[CH}{}_2CH_2OC(O)C_{15}H_{31}]_2\ Br^{\theta}$ $[C_2H_5]_2{}^{\oplus}N[CH_2CH_2OC(O)C_{17}H_{35}]_2\ Cl^{\theta}$ $[CH_3][C_2H_5]^{\oplus}N[CH_2CH_2OC(O)C_{13}H_{27}]_2\ I^{\theta}$ $[C_3H_7][C_2H_5]^{\oplus}N[CH_2CH_2OC(O)C_{15}H_{31}]_2\ SO_4{}^{\theta}\ CH_3$ $[CH_3]_2{}^{\oplus}N—CH_2CH_2OC(O)C_{15}H_{31}\quad Cl^{\ominus}$
$\quad\quad |$
$\quad\quad CH_2CH_2OC(O)C_{17}H_{35}$ $[CH_2CH_2OH][CH_3]^{\oplus}N[CH_2CH_2OC(O)R^2]_2\quad Cl^{\ominus}$ $[CH_3]_2{}^{\oplus}N[CH_2CH_2OC(O)R^2]\quad Cl^{\ominus}$ where —C(O)$R^2$ is derived from hardened tallow.

Since the foregoing compounds (diesters) are somewhat labile to hydrolysis, they should be handled rather carefully when used to formulate the compositions herein. pH ranges for making stable softener compositions containing diester quaternary ammonium fabric softening compounds are disclosed in U.S. Pat. No. 4,767,547, supra, and is incorporated herein by reference.

The diester quaternary ammonium fabric softening compound (DEQA) can also have the general formula:

$$\begin{array}{l} R^2C(O)OCH_2 \\ \quad\quad\quad\quad\quad\quad \diagdown \\ \quad\quad\quad\quad\quad\quad CHCH_2{}^{\oplus}NR_3\quad X^{\ominus} \\ \quad\quad\quad\quad\quad\quad \diagup \\ R^2C(O)O \end{array}$$

wherein each R, $R^2$, and X have the same meanings as before. Such compounds include those having the formula:

$[CH_3]_3{}^{\oplus}N[CH_2CH(CH_2OC[O]R^2)OC(O)R^2]Cl^{\theta}$ where —OC(O)$R^2$ is derived from hardened tallow. Combinations of hard and soft tallow can be used.

Preferably each R is a methyl or ethyl group and preferably each $R^2$ is in the range of $C_{15}$ to $C_{19}$. Degrees of branching, substitution and/or non-saturation can be present in the alkyl chains. The anion $X^-$ in the molecule is preferably the anion of a strong acid and can be, for example, chloride, bromide, iodide, sulphate and methyl sulphate; the anion can carry a double charge in which case $X^-$ represents half a group.

These types of compounds and general methods of making them are disclosed in U.S. Pat. No. 4,137,180, Naik et al., issued Jan. 30, 1979, which is incorporated herein by reference.

(B) Viscosity/Dispersibility Modifiers

(B)(1) The Single-Long-Chain Alkyl Cationic Surfactant

The mono-long-chain-alkyl (water-soluble) cationic surfactants are present in solid compositions (I) at a level of from 0% to about 15%, preferably from about 3% to about 15%, more preferably from about 5% to about 15%, the total single-long-chain cationic surfactant present being at least at an effective level to provide dispersibility and/or protection against detergent ingredients carried over from the wash portion of the cycle.

Such mono-long-chain-alkyl cationic surfactants useful in the present invention are, preferably, quaternary ammonium salts of the general formula:

$[R^2N^{\oplus}R_3]X^{\theta}$ wherein the $R^2$ group is $C_{10}$–$C_{22}$ hydrocarbon group, preferably $C_{12}$–$C_{18}$ alkyl group or the corresponding ester linkage interrupted group with a short alkylene ($C_1$–$C_4$) group between the ester linkage and the N, and having a similar hydrocarbon group, e.g., a fatty acid ester of choline, preferably $C_{12}$–$C_{14}$ (coco) choline ester and/or $C_{16}$–$C_{18}$ tallow choline ester, preferably a bimodal mixture of choline ester where one has a long chain of about 12 carbon atoms and one has a long chain of about 18 carbon atoms. Each R is a $C_1$–$C_4$ alkyl or substituted (e.g., hydroxy) alkyl, or hydrogen, preferably methyl, and the counterion Xθ is a softener compatible anion, for example, chloride, bromide, methyl sulfate, etc.

The numerical ranges above represent the amount of the single-long-chain-alkyl cationic surfactant which is added to the composition of the present invention. The ranges do not include the amount of monoester which is already present in component (A), the diester quaternary ammonium compound, the total present being at least at said effective level.

The long chain group $R^2$, of the single-long-chain-alkyl cationic surfactant, typically contains an alkylene group having from about 10 to about 22 carbon atoms, preferably from about 12 to about 16 carbon atoms for solid compositions. This $R^2$ group can be attached to the cationic nitrogen atom through a group containing one, or more, ester, amide, ether, amine, etc., preferably ester, linking groups which can be desirable for increased hydrophilicity, biodegradability, etc. Such linking groups are preferably within about three carbon atoms of the nitrogen atom. Suitable biodegradable single-long-chain alkyl cationic surfactants containing an ester linkage in the long chain are described in U.S. Pat. No. 4,840,738, Hardy and Walley, issued Jun. 20, 1989, said patent being incorporated herein by reference.

If the corresponding, non-quaternary amines are used, any acid (preferably a mineral or polycarboxylic acid) which is added to keep the ester groups stable will also keep the amine protonated in the compositions and preferably during the rinse so that the amine has a cationic group.

It will be understood that the main function of the watersoluble cationic surfactant is to increase the dispersibility of the diester softener and it is not, therefore, essential that the cationic surfactant itself have substantial softening properties, although this may be the case. Also, surfactants having only a single long alkyl chain, presumably because they have greater solubility in water, can protect the diester softener from interacting with anionic surfactants and/or detergent builders that are carried over into the rinse from the wash step.

Other cationic materials with ring structures such as alkyl imidazoline, imidazolinium, pyridine, and pyridinium salts having a single $C_{12}$–$C_{30}$ alkyl chain can also be used. Very low pH is required to stabilize, e.g., imidazoline ring structures.

Some alkyl imidazolinium salts useful in the present invention have the general formula:

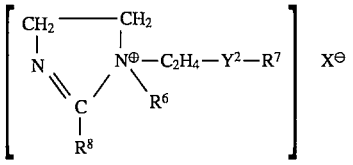

wherein $Y^2$ is —C(O)—O—, —O—(O)—C—, —C(O)—N($R^5$)—, or —N($R^5$)—C(O)— in which $R^5$ is hydrogen or a $C_1$–$C_4$ alkyl radical; $R^6$ is a $C_1$–$C_4$ alkyl radical; $R^7$ and $R^8$ are each independently selected from R and $R^2$ as defined hereinbefore for the single-long-chain cationic surfactant with only one being $R^2$.

Some alkyl pyridinium salts useful in the present invention have the general formula:

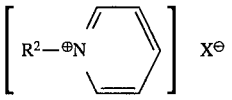

wherein $R^2$ and Xθ are as defined above. A typical material of this type is cetyl pyridinium chloride.

(B)(2) Nonionic Surfactant (Alkoxylated Materials)

Suitable nonionic surfactants to serve as the viscosity/dispersibility modifier include addition products of ethylene oxide and, optionally, propylene oxide, with fatty alcohols, fatty acids, fatty amines, etc.

Any of the alkoxylated materials of the particular type described hereinafter can be used as the nonionic surfactant. In general terms, the nonionics herein, when used alone, in solid compositions (I) are at a level of from about 5% to about 20%, preferably from about 8% to about 15%. Suitable compounds are substantially water-soluble surfactants of the general formula:

$$R^2—Y—(C_2H_4O)_z—C_2H_4OH$$

wherein $R^2$ for solid compositions is selected from the group consisting of primary, secondary and branched chain alkyl and/or acyl hydrocarbyl groups; primary, secondary and branched chain alkenyl hydrocarbyl groups; and primary, secondary and branched chain alkyl- and alkenyl-substituted phenolic hydrocarbyl groups; said hydrocarbyl groups having a hydrocarbyl chain length of from about 8 to about 20, preferably from about 10 to about 18 carbon atoms. More preferably, the hydrocarbyl chain length for solid compositions (I) is from about 10 to about 14 carbon atoms. In the general formula for the ethoxylated nonionic surfactants herein, Y is typically —O—, —C(O)O—, —C(O)N(R)—, or —C(O)N(R)$R^3$—, in which $R^3$ is an alkylene group having up to about 10 carbon atoms, and R, when present, has the meaning given hereinbefore, and/or R can be hydrogen, and z is at least about 8, preferably at least about 10–11. Performance of the softener composition decreases when fewer ethoxylate groups are present.

The nonionic surfactants herein are characterized by an HLB (hydrophilic-lipophilic balance) of from about 7 to about 20, preferably from about 8 to about 15. Of course, by defining $R^2$ in the nonionic surfactant and the number of ethoxylate groups, the HLB of the surfactant is, in general, determined. However, it is to be noted that the nonionic ethoxylated surfactants useful herein contain relatively long chain $R^2$ groups and are relatively highly ethoxylated. While shorter alkyl chain surfactants having short ethoxylated groups may possess the requisite HLB, they are not as effective herein.

Nonionic surfactants as the viscosity/dispersibility modifiers .are preferred over the other modifiers disclosed herein for compositions with higher levels of perfume.

Examples of nonionic surfactants follow. The nonionic surfactants of this invention are not limited to these examples. In the examples, the integer defines the number of ethoxyl (EO) groups in the molecule.

(B)(2)(a) Straight-Chain, Primary Alcohol Alkoxylates

The deca-, undeca-, dodeca-, tetradeca-, and pentadeca-ethoxylates of n-hexadecanol, and n-octadecanol having an HLB within the range recited herein are useful viscosity/dispersibility modifiers in the context of this invention. Exemplary ethoxylated primary alcohols useful herein as the viscosity/dispersibility modifiers of the compositions are n—$C_{18}$EO(10); and n—$C_{10}$EO(11). The ethoxylates of mixed natural or synthetic alcohols in the "tallow" chain length range are also useful herein. Specific examples of such materials include tallow-alcohol-EO(11), tallowalcohol —EO(18), and tallowalcohol —EO(25).

(B)(2)(b) Straight-Chain, Secondary Alcohol Alkoxylates

The deca-, undeca-, dodeca-, tetradeca-, pentadeca-, octadeca-, and nonadeca-ethoxylates of 3-hexadecanol, 2-octadecanol, 4-eicosanol, and 5-eicosanol having and HLB within the range recited herein are useful viscosity/dispersibility modifiers in the context of this invention. Exemplary ethoxylated secondary alcohols useful herein as the viscosity/dispersibility modifiers of the compositions are: 2—$C_{16}$EO(11); 2—$C_{20}$EO(11); and 2—$C_{16}$EO(14).

(B)(2)(c) Alkyl Phenol Alkoxylates

As in the case of the alcohol alkoxylates, the hexa- through octadeca-ethoxylates of alkylated phenols, particularly monohydric alkylphenols, having an HLB within the range recited herein are useful as the viscosity/dispersibility modifiers of the instant compositions. The hexa- through octadeca-ethoxylates of p-tridecylphenol, m-pentadecylphenol, and the like, are useful herein. Exemplary ethoxylated alkylphenols useful as the viscosity/dispersibility modifiers of the mixtures herein are: p-tridecylphenol EO(11) and p-pentadecylphenol EO(18).

As used herein and as generally recognized in the art, a phenylene group in the nonionic formula is the equivalent of an alkylene group containing from 2 to 4 carbon atoms. For present purposes, nonionics containing a phenylene group are considered to contain an equivalent number of carbon atoms calculated as the sum of the carbon atoms in the alkyl group plus about 3.3 carbon atoms for each phenylene group.

(B)(2)(d) Olefinic Alkoxylates

The alkenyl alcohols, both primary and secondary, and alkenyl phenols corresponding to those disclosed immediately hereinabove can be ethoxylated to an HLB within the range recited herein and used as the viscosity/dispersibility modifiers of the instant compositions.

(B)(2)(e) Branched Chain Alkoxylates

Branched chain primary and secondary alcohols which are available from the well-known "OXO" process can be ethoxylated and employed as the viscosity/dispersibility modifiers of compositions herein.

The above ethoxylated nonionic surfactants are useful in the present compositions alone or in combination, and the term "nonionic surfactant" encompasses mixed nonionic surface active agents.

(B)(3) Mixtures

The term "mixture" includes the nonionic surfactant and the single-long-chain-alkyl cationic surfactant added to the composition in addition to any monoester present in the DEQA.

Mixtures of the above viscosity/dispersibility modifiers are highly desirable. The single long chain cationic surfactant provides improved dispersibility and protection for the primary DEQA against anionic surfactants and/or detergent builders that are carried over from the wash solution.

Mixtures of the viscosity/dispersibility modifiers are present for solid compositions (I) at a level of from about 3% to about 30%, preferably from about 5% to about 20% by weight of the composition.

(C) Low Viscosity Premix Composition Containing Diester Quaternary Ammonium Compound and Premix Fluidizers The premix composition of the present invention consists essentially of DEQA, optionally, a viscosity and/or dispersibility modifier, and a premix fluidizer. The molten premix is used to form a solid (I) by cooling and/or by solvent removal.

It can be advantageous to use an effective amount of a fluidizer in the DEQA molten premix in formulating the compositions of the present invention. Preferably the viscosity of the premix should be about 10,000 cps or less, preferably about 4,000 cps or less, more preferably about 2,000 cps or less. The temperature of the molten premix is about 100° C. or less, preferably about 95° C. or less, more preferably about 85° C. or less.

Useful premix fluidizers include those selected from the group consisting of:

1. from about 1% to about 15%, preferably from about 2% to about 10% of linear fatty monoesters, such as fatty acid esters of low molecular weight alcohols, having a ratio to DEQA of from about 1:5 to about 1:100, preferably from about 1:10 to about 1:50;
2. from about 2% to about 25%, preferably from about 4% to about 15%, of short chain ($C_1$–$C_3$) alcohols having a ratio to DEQA of from about 1:3 to about 1:50, preferably from about 1:5 to about 1:25;
3. from about 1% to about 40%, preferably from about 2% to about 30%, of di-substituted imidazoline ester softening compounds having a ratio to DEQA of from about 2:3 to about 1:100, preferably from about 1:2 to about 1:50;
4. from about 1% to about 20%, preferably from about 2% to about 10%, of fatty alkyl imidazoline or imidazoline alcohols, having a ratio to DEQA of from about 1:4 to about 1:100, preferably from about 1:8 to about 1:50;
5. from about 1% to about 35%, preferably from about 2% to about 25%, of (B)(1) water-soluble, single-long-chain-alkyl cationic surfactants as described hereinbefore, especially mono fatty alkyl, e.g., tallow alkyl, trimethyl ammonium chloride, having a ratio to DEQA of from about 1:2 to about 1:100, preferably from about 1:3 to about 1:50;
6. from about 1% to about 40%, preferably from about 2% to about 25%, of $C_{10}$–$C_{22}$ di-long-chain amines, di-long-chain ester amines, mono-long-chain amines, mono-long-chain ester amines, alkylene polyammonium salts (e.g., lysine and 1,5-diammonium 2-methyl pentane dihydrochloride), and/or amine oxides. These have a ratio to DEQA of from about 1:2 to about 1:100, preferably from about 1:4 to about 1:50;
7. from about 1% to about 25%, preferably from about 2% to about 10%, of $C_{10}$–$C_{22}$ alkyl or alkenyl succinic anhydrides or acids and/or $C_{10}$–$C_{22}$ long-chain fatty alcohols and fatty acids. These have a ratio to DEQA of from about 1:3 to about 1:100, preferably from about 1:10 to about 1:50; and
8. mixtures thereof.

Preferably the premix fluidizers are selected from the group consisting of 1, 3, 4, 5 and mixtures thereof.

Short chain alcohols (low molecular weight alcohols), fatty alcohols, and fatty acids, mixed with DEQA and a viscosity and/or dispersibility modifier will produce fluid premix compositions.

Linear fatty monoesters, discussed hereinbefore and hereinafter in more detail, can be added to the DEQA premix as fluidizers. An example of a DEQA premix fluidizer is methyl-tallowate.

As discussed hereinbefore, a potential source of water-soluble, cationic surfactant material is the DEQA itself. As a raw material, DEQA comprises a small percentage of monoester. Monoester can be formed by either incomplete esterification or by hydrolyzing a small amount of DEQA and thereafter extracting the fatty acid by-product. Generally, the composition of the present invention should only have low levels of, and preferably is substantially free of, free fatty acid by-product or free fatty acids from other sources because it inhibits effective processing of the composition. The level of free fatty acid in the compositions of the present invention is no greater than about 5% by weight of the composition and preferably no greater than about 25% by weight of the diester quaternary ammonium compound.

Di-substituted imidazoline ester softening compounds, imidazoline alcohols, and monotallow trimethyl ammonium chloride are discussed hereinbefore and hereinafter.

(D) Optional Ingredients

In addition to the above components, the solid particulate composition (I) can have one or more of the following optional ingredients.

(D)(1) Essentially Linear Fatty Acids and/or Fatty Alcohol Monoesters

Optionally, an essentially linear fatty monoester can be added to the composition of the present invention and is often present in at least a small amount as a minor ingredient in the DEQA raw material.

Monoesters of essentially linear fatty acids and/or alcohols, which aid said modifier, contain from about 12 to about 25, preferably from about 13 to about 22, more preferably from about 16 to about 20, total carbon atoms, with the fatty moiety, either acid or alcohol, containing from about 10 to about 22, preferably from about 12 to about 18, more preferably from about 16 to about 18, carbon atoms. The shorter moiety, either alcohol or acid, contains from 1 to about 4, preferably from 1 to about 2, carbon atoms. Preferred are fatty acid esters of lower alcohols, especially methanol. These linear monoesters are sometimes present in the DEQA raw material or can be added to a DEQA premix as a premix fluidizer, and/or added to aid the viscosity/dispersibility modifier in the processing of the softener composition.

(D)(2) Optional Nonionic Softener

An optional additional softening agent of the solid particulate composition (I) is a nonionic fabric softener material. Typically, such nonionic fabric softener materials have an HLB of from about 2 to about 9, more typically from about 3 to about 7. Such nonionic fabric softener materials tend to be readily dispersed either by themselves, or when combined with other materials such as single-long-chain alkyl cationic surfactant described in detail hereinbefore. Dispersibility can be improved by using more single-long-chain alkyl cationic surfactant, mixture with other materials as set forth hereinafter, use of hotter water, and/or more agitation. In general, the materials selected should be relatively crystalline, higher melting, (e.g., >~50° C.) and relatively water insoluble.

The level of optional nonionic softener in the solid composition (I) is typically from about 10% to about 40%, preferably from about 15% to about 30%, and the ratio of the optional nonionic softener to DEQA is from about 1:6 to about 1:2, preferably from about 1:4 to about 1:2.

Preferred nonionic softeners are fatty acid partial esters of polyhydric alcohols, or anhydrides thereof, wherein the alcohol, or anhydride, contains from 2 to about 18, preferably from 2 to about 8, carbon atoms, and each fatty acid moiety contains from about 12 to about 30, preferably from about 16 to about 20, carbon atoms. Typically, such softeners contain from 1 to about 3, preferably about 2 fatty acid groups per molecule.

The polyhydric alcohol portion of the ester can be ethylene glycol, glycerol, poly (e.g., di-, tri-, tetra, penta-, and/or hexa-) glycerol, xylitol, sucrose, erythritol, pentaerythritol, sorbitol or sorbitan. Sorbitan esters and polyglycerol monostearate are particularly preferred.

The fatty acid portion of the ester is normally derived from fatty acids having from about 12 to about 30, preferably from about 16 to about 20, carbon atoms, typical examples of said fatty acids being lauric acid, myristic acid, palmitic acid, stearic acid and behenic acid.

Highly preferred optional nonionic softening agents for use in the present invention are the sorbitan esters, which are esterified dehydration products of sorbitol, and the glycerol esters.

Sorbitol, which is typically prepared by the catalytic hydrogenation of glucose, can be dehydrated in well known fashion to form mixtures of 1,4- and 1,5-sorbitol anhydrides and small amounts of isosorbides. (See U.S. Pat. No. 2,322,821, Brown, issued Jun. 29, 1943, incorporated herein by reference.)

The foregoing types of complex mixtures of anhydrides of sorbitol are collectively referred to herein as "sorbitan." It will be recognized that this "sorbitan" mixture will also contain some free, uncyclized sorbitol.

The preferred sorbitan softening agents of the type employed herein can be prepared by esterifying the "sorbitan" mixture with a fatty acyl group in standard fashion, e.g., by reaction with a fatty acid halide or fatty acid. The esterification reaction can occur at any of the available hydroxyl groups, and various mono-, di-, etc., esters can be prepared. In fact, mixtures of mono-, di-, tri-, etc., esters almost always result from such reactions, and the stoichiometric ratios of the reactants can be simply adjusted to favor the desired reaction product.

For commercial production of the sorbitan ester materials, etherification and esterification are generally accomplished in the same processing step by reacting sorbitol directly with fatty acids. Such a method of sorbitan ester preparation is described more fully in MacDonald; "Emulsifiers:" Processing and Quality Control:, *Journal of the American Oil Chemists' Society,* Vol. 45, October 1968.

Details, including formula, of the preferred sorbitan esters can be found in U.S. Pat. No. 4,128,484, incorporated hereinbefore by reference.

Certain derivatives of the preferred sorbitan esters herein, especially the "lower" ethoxylates thereof (i.e., mono-, di-, and tri-esters wherein one or more of the unesterified —OH groups contain one to about twenty oxyethylene moieties [Tweens®] are also useful in the composition of the present invention. Therefore, for purposes of the present invention, the term "sorbitan ester" includes such derivatives.

For the purposes of the present invention, it is preferred that a significant amount of di- and tri- sorbitan esters are present in the ester mixture. Ester mixtures having from 20–50% mono-ester, 25–50% di-ester and 10–35% of tri- and tetra-esters are preferred.

The material which is sold commercially as sorbitan monoester (e.g., monostearate) does in fact contain significant amounts of di- and tri-esters and a typical analysis of sorbitan monostearate indicates that it comprises ca. 27% mono-, 32% di- and 30% tri- and tetra-esters. Commercial sorbitan monostearate therefore is a preferred material. Mixtures of sorbitan stearate and sorbitan palmirate having stearate/palmitate weight ratios varying between 10:1 and 1:10, and 1,5-sorbitan esters are useful. Both the 1,4- and 1,5-sorbitan esters are useful herein.

Other useful alkyl sorbitan esters for use in the softening compositions herein include sorbitan monolaurate, sorbitan monomyristate, sorbitan monopalmitate, sorbitan monobehenate, sorbitan monooleate, sorbitan dilaurate, sorbitan dimyristate, sorbitan dipalmitate, sorbitan distearate, sorbitan dibehenate, sorbitan dioleate, and mixtures thereof, and mixed tallowalkyl sorbitan mono- and di-esters. Such mixtures are readily prepared by reacting the foregoing hydroxy-substituted sorbitans, particularly the 1,4- and 1,5-sorbitans, with the corresponding acid or acid chloride in a simple esterification reaction. It is to be recognized, of course, that commercial materials prepared in this manner will comprise mixtures usually containing minor proportions of uncyclized sorbitol, fatty acids, polymers, isosorbide structures, and the like. In the present invention, it is preferred that such impurities are present at as low a level as possible.

The preferred sorbitan esters employed herein can contain up to about 15% by weight of esters of the $C_{20}$–$C_{26}$, and higher, fatty acids, as well as minor amounts of $C_8$, and lower, fatty esters.

Glycerol and polyglycerol esters, especially glycerol, diglycerol, triglycerol, and polyglycerol mono- and/or di-esters, preferably mono-, are also preferred herein (e.g., polyglycerol monostearate with a trade name of Radiasurf 7248). Glycerol esters can be prepared from naturally occurring triglycerides by normal extraction, purification and/or interesterification processes or by esterification processes of the type set forth hereinbefore for sorbitan esters. Partial esters of glycerin can also be ethoxylated to form usable derivatives that are included within the term "glycerol esters."

Useful glycerol and polyglycerol esters include monoesters with stearic, oleic, palmitic, laurie, isostearic, myristic, and/or behenic acids and the diesters of stearic, oleic, palmitic, lauric, isostearic, behenic, and/or myristic acids. It is understood that the typical mono-ester contains some di- and tri-ester, etc.

The "glycerol esters" also include the polyglycerol, e.g., diglycerol through octaglycerol esters. The polyglycerol polyols are formed by condensing glycerin or epichlorohydrin together to link the glycerol moieties via ether linkages. The mono- and/or diesters of the polyglycerol polyols are preferred, the fatty acyl groups typically being those described hereinbefore for the sorbitan and glycerol esters.

The performance of, e.g., glycerol and polyglycerol monoesters is improved by the presence of the diester cationic material, described hereinbefore.

Still other desirable optional "nonionic" softeners are ion pairs of anionic detergent surfactants and fatty amines, or quaternary ammonium derivatives thereof, e.g., those disclosed in U.S. Pat. No. 4,756,850, Nayar, issued Jul. 12, 1988, said patent being incorporated herein by reference. These ion pairs act like nonionic materials since they do not readily ionize in water. They typically contain at least two long hydrophobic groups (chains).

The ion-pair complexes can be represented by the following formula:

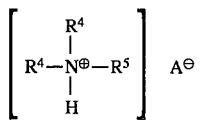

wherein each $R^4$ can independently be $C_{12}$–$C_{20}$ alkyl or alkenyl, and $R^5$ is H or $CH_3$. $A^\theta$ represents an artionic compound and includes a variety of anionic surfactants, as well as related shorter alkyl chain compounds which need not exhibit surface activity. $A^-$ is selected from the group consisting of alkyl sulfonates, aryl sulfonates, alkylaryl sulfonates, alkyl sulfates, dialkyl sulfosuccinates, alkyl oxybenzene sulfonates, acyl isethionates, acylalkyl taurates, alkyl ethoxylated sulfates, olefin sulfonates, preferably benzene sulfonates, and $C_1$–$C_5$ linear alkyl benzene sulfonates, or mixtures thereof.

The terms "alkyl sulfonate" and "linear alkyl benzene sulfonate" as used herein shall include alkyl compounds having a sulfonate moiety both at a fixed location along the carbon chain, and at a random position along the carbon chain. Starting alkylamines are of the formula:

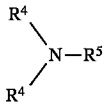

wherein each $R^4$ is $C_{12}$–$C_{20}$ alkyl or alkenyl, and $R^5$ is H or $CH_3$.

The artionic compounds ($A^-$) useful in the ion-pair complex of the present invention are the alkyl sulfonates, aryl sulfonates, alkylaryl sulfonates, alkyl sulfates, alkyl ethoxylated sulfates, dialkyl sulfosuccinates, ethoxylated alkyl sulfonates, alkyl oxybenzene sulfonates, acyl isethionates, acylalkyl taurates, and paraffin sulfonates.

The preferred anions ($A^\theta$)) useful in the ion-pair complex of the present invention include benzene sulfonates and $C_1$–$C_5$ linear alkyl benzene sulfonates (LAS), particularly $C_1$–$C_3$ LAS. Most preferred is $C_3$ LAS. The benzene sulfonate moiety of LAS can be positioned at any carbon atom of the alkyl chain, and is commonly at the second atom for alkyl chains containing three or more carbon atoms.

More preferred are complexes formed from the combination of ditallow amine (hydrogenated or unhydrogenated) complexed with a benzene sulfonate or $C_1$–$C_5$ linear alkyl benzene sulfonate and distearyl amine complexed with a benzene sulfonate or with a $C_1$–$C_5$ linear alkyl benzene sulfonate. Even more preferred are those complexes formed from hydrogenated ditallow amine or distearyl amine complexed with a $C_1$–$C_3$ linear alkyl benzene sulfonate (LAS). Most preferred are complexes formed from hydrogenated ditallow amine or distearyl amine complexed with $C_3$ linear alkyl benzene sulfonate.

The ion pair complex is not expected to disperse in water but will be delivered to the rinse water as a solid particulate which will then deposit on the fabrics. Thereafter, in the dryer, the ion complex will meet and spread to deliver an antistatic benefit.

The amine and anionic compound are combined in a molar ratio of amine to anionic compound ranging from about 10:1 to about 1:2, preferably from about 5:1 to about 1:2, more preferably from about 2:1 to about 1:2, and most preferably 1:1. This can be accomplished by any of a variety of means, including but not limited to, preparing a melt of the anionic compound (in acid form) and the amine, and then processing to the desired particle size range.

A description of ion-pair complexes, methods of making, and non-limiting examples of ion-pair complexes and starting amines suitable for use in the present invention are listed in U.S. Pat. No. 4,915,854, Mao et al., issued Apr. 10, 1990, and U.S. Pat. No. 5,019,280, Caswell et al., issued May 28, 1991, both patents incorporated herein by reference.

Generically, the ion pairs useful herein are formed by reacting an amine and/or a quaternary ammonium salt containing at least one, and preferably two, long hydrophobic chains ($C_{12}$–$C_{30}$, preferably $C_{11}$–$C_{20}$) with an anionic detergent surfactant of the types disclosed in said U.S. Pat. No. 4,756,850, especially at Col. 3, lines 29–47. Suitable methods for accomplishing such a reaction are also described in U.S. Pat. No. 4,756,850, at Col. 3, lines 48–65.

The equivalent ion pairs formed using $C_{12}$–$C_{30}$ fatty acids are also desirable. Examples of such materials are known to be good fabric softeners as described in U.S. Pat. No. 4,237,155, Kardouche, issued Dec. 2, 1980, said patent being incorporated herein by reference.

Other fatty acid partial esters useful in the present invention are ethylene glycol distearate, propylene glycol distearate, xylitol monopalmitate, pentaerythritol monostearate, sucrose monostearate, sucrose distearate, and glycerol monostearate. As with the sorbitan esters, commercially available mono-esters normally contain substantial quantities of di- or tri- esters.

Still other suitable nonionic fabric softener materials include long chain fatty alcohols and/or acids and esters thereof containing from about 16 to about 30, preferably from about 18 to about 22, carbon atoms, esters of such compounds with lower ($C_1$–$C_4$) fatty alcohols or fatty acids, and lower (1–4) alkoxylation ($C_1$–$C_4$) products of such materials.

These other fatty acid partial esters, fatty alcohols and/or acids and/or esters thereof, and alkoxylated alcohols and those sorbitan esters which do not form optimum emulsions/dispersions can be improved by adding other di-long-chain cationic material, as disclosed hereinbefore and hereinafter, or other nonionic softener materials to achieve better results.

The above-discussed nonionic compounds are correctly termed "softening agents," because when the compounds are correctly, applied to a fabric, they do impart a soft, lubricious feel to the fabric. However, they require a cationic material if one wishes to efficiently apply such compounds from a dilute, aqueous rinse solution to fabrics. Good deposition of the above compounds is achieved through their combination with the cationic softeners discussed hereinbefore and hereinafter. The fatty acid partial ester materials are preferred for biodegradability and the ability to adjust the HLB of the nonionic material in a variety of ways, e.g., by varying the distribution of fatty acid chain lengths, degree of saturation, etc., in addition to providing mixtures. The nonionic softeners, discussed hereinabove, can also be utilized as the nonionic softeners in the compositions of (II) discussed hereinbelow. The level of nonionic softener in the compositions of (II) is from about 20% to about 95%, preferably from about 50% to about 85%, more preferably from about 60% to about 80%.

(D)(3) Optional Imidazoline Softening Compound

Optionally, the solid composition of the present invention contains from about 1% to about 47%, preferably from about 5% to about 20%, of a di-substituted imidazoline softening compound of the formula:

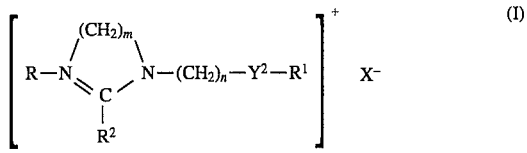

(I)

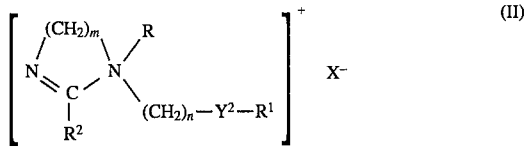

(II)

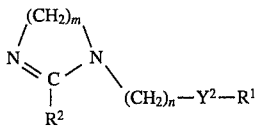

(III)

or mixtures thereof, wherein $Y^2$ is as defined hereinbefore; $R^1$ and $R^2$ are, independently, a $C_{11}$–$C_{21}$ hydrocarbyl group, preferably a $C_{13}$–$C_{17}$ alkyl group, most preferably a straight chained tallow alkyl group; R is a $C_1$–$C_4$ hydrocarbyl group, preferably a $C_1$–$C_3$ alkyl, alkenyl or hydroxyalkyl group, e.g., methyl (most preferred), ethyl, propyl, propenyl, hydroxyethyl, 2-, 3-di-hydroxypropyl and the like; and m and n are, independently, from about 2 to about 4, preferably about 2. The counterion $X^-$ can be any softener compatible anion, for example, chloride, bromide, methylsulfate, ethylsulfate, formate, sulfate, nitrate, and the like.

The above compounds can optionally be added to the composition of the present invention as a DEQA premix fluidizer or added later in the composition's processing for their softening, scavenging, and/or antistatic benefits. When these compounds are added to DEQA premix as a premix fluidizer, the compound's ratio to DEQA is from about 2:3 to about 1:100, preferably from about 1:2to about 1:50.

Compounds (I) and (II) can be prepared by quaternizing a substituted imidazoline ester compound. Quaternization may be achieved by any known quaternization method. A preferred quaternization method is disclosed in U.S. Pat. No. 4,954,635, Rosario-Jansen et al., issued Sep. 4, 1990, the disclosure of which is incorporated herein by reference.

The di-substituted imidazoline compounds contained in the compositions of the present invention are believed to be biodegradable and susceptible to hydrolysis due to the ester group in the alkyl substituent. Furthermore, the imidazoline compounds contained in the compositions of the present invention are susceptible to ring opening under certain conditions. As such, care should be taken to handle these compounds under conditions which avoid these consequences.

In many cases, it is advantageous to use a 3-component composition comprising: (I)(A) a diester quaternary ammonium cationic softener such as di(tallowoyloxy ethyl) dimethylammonium chloride; (II)(B) a viscosity/dispersibility modifier, e.g., mono-long-chain alkyl cationic surfactant such as fatty acid choline ester, cetyl or tallow alkyl trimethylammonium bromide or chloride, etc., a nonionic surfactant, or mixtures thereof; and (D)(3) a di-long-chain imidazoline ester compound in place of some of the DEQA. The additional di-long-chain imidazoline ester compound, as well as providing additional softening and, especially, antistatic benefits, also acts as a reservoir of additional positive charge, so that any anionic surfactant which is carried over into the rinse solution from a conventional washing process is effectively neutralized.

(D)(4) Optional Soil Release Agent

Optionally, the compositions herein contain from 0% to about 10%, preferably from about 0.1% to about 5%, more preferably from about 0.1% to about 2%, of a soil release agent. Preferably, such a soil release agent is a polymer. Polymeric soil release agents useful in the present invention include copolymeric blocks of terephthalate and polyethylene oxide or polypropylene oxide, and the like. These agents give additional stability to the concentrated aqueous, liquid compositions. Therefore, their presence in such liquid compositions, even at levels which do not provide soil release benefits, is preferred.

A preferred soil release agent is a copolymer having blocks of terephthalate and polyethylene oxide. More specifically, these polymers are comprised of repeating units of ethylene and/or propylene terephthalate and polyethylene oxide terephthalate at a molar ratio of ethylene terephthalate units to polyethylene oxide terephthalate units of from about 25:75 to about 35:65, said polyethylene oxide terephthalate containing polyethylene oxide blocks having molecular weights of from about 300 to about 2000. The molecular weight of this polymeric soil release agent is in the range of from about 5,000 to about 55,000.

Another preferred polymeric soil release agent is a crystallizable polyester with repeat units of ethylene terephthalate units containing from about 10% to about 15% by weight of ethylene terephthalate units together with from about 10% to about 50% by weight of polyoxyethylene terephthalate units, derived from a polyoxyethylene glycol of average molecular weight of from about 300 to about 6,000, and the molar ratio of ethylene terephthalate units to polyoxyethylene terephthalate units in the crystallizable polymeric compound is between 2:1 and 6:1. Examples of this polymer include the commercially available materials Zelcon® 4780 ( from DuPont) and Milease® T (from ICI).

Highly preferred soil release agents are polymers of the generic formula:

$$X-(OCH_2CH_2)_n(O-\overset{O}{\overset{\|}{C}}-R^1-\overset{O}{\overset{\|}{C}}-OR^2)_u(O-\overset{O}{\overset{\|}{C}}-R^1-\overset{O}{\overset{\|}{C}}-O)(CH_2CH_2O)_n-X$$

in which X can be any suitable capping group, with each X being selected from the group consisting of H, and alkyl or acyl groups containing from about 1 to about 4 carbon atoms, preferably methyl. n is selected for water solubility and generally is from about 6 to about 113, preferably from about 20 to about 50. u is critical to formulation having a relatively high ionic strength. There should be very little material in which u is greater than 10. Furthermore, there should be at least 20%, preferably at least 40%, of material in which u ranges from about 3 to about 5.

The $R^1$ moieties are essentially 1,4-phenylene moieties. As used herein, the term the $R^1$ moieties are essentially 1,4-phenylene moieties" refers to compounds where the $R^1$ moieties consist entirely of 1,4-phenylene moieties, or are partially substituted with other arylene or alkarylene moieties, alkylene moieties, alkenylene moieties, or mixtures thereof. Arylene and alkarylene moieties which can be partially substituted for 1,4-phenylene include 1,3-phenylene, 1,2-phenylene, 1,8-naphthylene, 1,4-naphthylene, 2,2-biphenylene, 4,4-biphenylene and mixtures thereof. Alkylene and alkenylene moieties which can be partially substituted include ethylene, 1,2-propylene, 1,4-butylene, 1,5-pentylene, 1,6-hexamethylene, 1,7-heptamethylene, 1,8-octamethylene, 1,4-cyclohexylene, and mixtures thereof.

For the $R^1$ moieties, the degree of partial substitution with moieties other than 1,4-phenylene should be such that the soil release properties of the compound are not adversely affected to any great extent. Generally, the degree of partial substitution which can be tolerated will depend upon the backbone length of the compound, i.e., longer backbones can have greater partial substitution for 1,4-phenylene moieties. .Usually, compounds where the $R^1$ comprise from about 50% to about 100% 1,4-phenylene moieties (from 0% to about 50% moieties other than 1,4-phenylene) have adequate soil release activity. For example, polyesters made according to the present invention with a 40:60 mole ratio of isophthalic (1,3-phenylene) to terephthalic (1,4-phenylene) acid have adequate soil release activity. However, because most polyesters used in fiber making comprise ethylene terephthalate units, it is usually desirable to minimize the degree of partial substitution with moieties other than 1,4-phenylene for best soil release activity. Preferably, the $R^1$ moieties consist entirely of (i.e., comprise 100%) 1,4-phenylene moieties, i.e., each $R^1$ moiety is 1,4-phenylene.

For the $R^2$ moieties, suitable ethylene or substituted ethylene moieties include ethylene, 1,2-propylene, 1,2-butylene, 1,2-hexylene, 3-methoxy-1,2-propylene and mixtures thereof. Preferably, the $R^2$ moieties are essentially ethylene moieties, 1,2-propylene moieties or mixture thereof. Inclusion of a greater percentage of ethylene moieties tends to improve the soil release activity of compounds. Surprisingly, inclusion of a greater percentage of 1,2-propylene moieties tends to improve the water solubility of the compounds.

Therefore, the use of 1,2-propylene moieties or a similar branched equivalent is desirable for incorporation of any substantial part of the soil release component in the liquid fabric softener compositions. Preferably, from about 75% to about 100%, more preferably from about 90% to about 100%, of the $R^2$ moieties are 1,2-propylene moieties.

The value for each n is at least about 6, and preferably is at least about 10. The value for each n usually ranges from about 12 to about 113. Typically, the value for each n is in the range of from about 12 to about 43.

A more complete disclosure of these highly preferred soil release agents is contained in U.S. Pat. No. 4,711,730, Gosselink and Diehl, issued Dec. 8, 1987, incorporated herein by reference.

(D) (5) Optional Bacteriocides

Examples of bacteriocides used in the compositions of this invention are glutaraldehyde, formaldehyde, 2-bromo-2-nitropropane-1,3-diol sold by Inolex Chemicals under the trade name Bronopol®, and a mixture of 5-chloro-2-methyl-4-isothiazolin-3-one and 2-methyl-4-isothiazoline-3-one sold by Rohm and Haas Company under the trade name Kathon® CG/ICP. Typical levels of bacteriocides used in the present compositions are from about 1 to about 1,000 ppm by weight of the composition.

Examples of antioxidants that can be added to the compositions of this invention are propyl gallate, available from Eastman Chemical Products, Inc., under the trade names Tenox® PG and Tenox S-1, and butylated hydroxy toluene, available from UOP Process Division under the trade name Sustane® BHT.

(D) (6) Other Optional Ingredient.

Inorganic viscosity control agents such as water-soluble, ionizable salts can also optionally be incorporated into the compositions of the present invention. A wide variety of ionizable salts can be used. Examples of suitable salts are the halides of the Group IA and IIA metals of the Periodic Table of the Elements, e.g., calcium chloride, magnesium chloride, sodium chloride, potassium bromide, and lithium chloride. The ionizable salts are particularly useful during the process of mixing the ingredients to make the compositions herein, and later to obtain the desired viscosity. The amount of ionizable salts used depends on the amount of active ingredients used in the compositions and can be adjusted according to the desires of the formulator. Typical levels of salts upon dilution used to control the composition viscosity are from about 20 to about 10,000 parts per million (ppm), preferably from about 20 to about 4,000 ppm, by weight of the composition.

Alkylene polyammonium salts can be incorporated into the composition to give viscosity control in addition to or in place of the water-soluble, ionizable salts above. In addition, these agents can act as scavengers, forming ion pairs with anionic detergent carried over from the main wash, in the rinse, and on the fabrics, and may improve softness performance. These agents may stabilize the viscosity over a broader range of temperature, especially at low temperatures, compared to the inorganic electrolytes.

Specific examples of alkylene polyammonium salts include 1-lysine monohydrochloride and 1,5-diammonium 2-methyl pentane dihydrochloride.

The preferred compositions used in the present invention can include other optional components conventionally used in textile treatment compositions, for example, colorants, perfumes, preservatives, optical brighteners, opacifiers, fabric conditioning agents, surfactants, stabilizers such as guar gum and polyethylene glycol, anti-shrinkage agents, anti-wrinkle agents, fabric crisping agents, spotting agents, germicides, fungicides, antioxidants such as butylated hydroxy toluene, anti-corrosion agents, and the like.

Preferably, the rinse bath contains from about 10 to about 1,000 ppm, preferably from about 50 to about 500 ppm, of the DEQA fabric softening compounds herein.

Solid Fabric Softener Compositions (I)

As discussed hereinbefore, the solid fabric softener compositions (I) of the present invention contain from about 50% to about 95%, preferably from about 60% to about 90% of (A) the diester quaternary ammonium compound. Levels of (B)(1) single-long-chain alkyl cationic surfactants as the viscosity/dispersibility modifier are from 0% to about 15%, preferably from about 3% to about 15%, more preferably from about 5% to about 15%, by weight of the compositions. Levels of (B)(2) nonionic surfactants are from about 5% to about 20%, preferably from about 8% to about 15%, by weight of the composition. Mixtures (B)(3) of these agents at a level of from about 3% to about 30%, preferably from about 5% to about 20%, by weight of the composition, can also effectively serve as viscosity/dispersibility modifiers.

The optimal degree of ethoxylation and hydrocarbyl chain length of the nonionic surfactant for a binary system (DEQA and nonionic surfactant (B)(2)) is $C_{10-14}$ $E_{10-18}$.

In solid compositions the low molecular weight alcohol level is less than about 4%, preferably less than about 3%.

The granules can be formed by preparing a melt, solidifying it by cooling, and then grinding and sieving to the desired size. It is highly preferred that the primary particles of the granules of both compositions (I) discussed hereinbefore and compositions (II) as discussed hereinafter, have a diameter of from about 50 to about 1,000, preferably from about 50 to about 400, more preferably from about 50 to about 200, microns. The granules can comprise smaller and larger particles, but preferably from about 85% to about 95%, more preferably from about 95% to about 100%, are within the indicated ranges. Smaller and larger particles do not provide optimum emulsions/dispersions when added to water. Other methods of preparing the primary particles can be used including spray cooling of the melt. The primary particles can be agglomerated to form a dust-free, non-tacky, free-flowing powder. The agglomeration can take place in a conventional agglomeration unit (i.e., Zig-Zag Blender, Lodige) by means of a water-soluble binder. Examples of water-soluble binders useful in the above agglomeration process include glycerol, polyethylene glycols, polymers such as PVA, polyacrylates, and natural polymers such as sugars.

The flowability of the granules can be improved by treating the surface of the granules with flow improvers such as clay, silica or zeolite particles, water-soluble inorganic salts, starch, etc.

In a three-component mixture of compositions (I), e.g., nonionic surfactant, single-long-chain cationic, and DEQA, it is more preferred, when forming the granules, to pre-mix the nonionic surfactant and the more soluble single-long-chain alkyl cationic compound before mixing in a melt of the diester quaternary ammonium cationic compound.

II. Solid Compositions having Nonionic Fabric Softener Material and Cationic Material (A) The Preferred Nonionic Softener Agents A highly preferred softening agent of the present invention is a nonionic fabric softener material, especially of the type that is optionally present in the previous compositions disclosed hereinbefore in section (D)(2). The level of nonionic softener in the granule composition of (II) is typically from about 20% to about 95%, preferably from about 50% to about 85%, more preferably from about 60% to about 80%.

(B) The Single-Long-Chain Alkyl Cationic Surfactant Material

The preferred mono-long-chain alkyl cationic surfactants useful in compositions of (II) with the preferred nonionic softener agents are the same as the ones discussed hereinbefore for compositions (B)(1). They are preferably quaternary ammonium salts of the general formula $R_1R_2R_3R_4N^{\oplus}X^{\theta}$, and the corresponding mono-long-chain alkyl unquaternized amines,*wherein groups $R_1$, $R_2$, $R_3$, $R_4$ are, for example, alkyl or substituted (e.g., hydroxy}alkyl, and X is an anion, for example, chloride, bromide, methyl sulfate, etc. The single-long-chain alkyl cationic surfactants are at a level of from about 5% to about 50%, preferably from about 10% to about 35%, more preferably from about 15% to about 30%.

The long chain typically contains from about 12 to about 30 carbon atoms, preferably from about 12 to about 22 carbon atoms, more preferably a bimodal mixture of cationic surfactant material where one has a long chain of about 12 carbon atoms and one has a long chain of about 18 carbon atoms. These can be interrupted with one, or more, ester, amide, ether, amine, etc., linking groups which can be desirable for increased hydrophilicity, biodegradability, etc. As discussed before, suitable biodegradable single-long-chain alkyl cationic surfactants containing an ester linkage in the long chain are described in U.S. Pat. No. 4,840,738, Hardy and Walley, issued Jun. 20, 1989, said patent being incorporated herein by reference.

Also, as discussed before, if amines are used, an acid (preferably a mineral or polycarboxylic acid) is added to keep the amine protonated in the compositions and preferably during the rinse, the composition may be buffered (pH from about 2 to about 5, preferably from about 2 to about 3) to maintain an appropriate, effective charge density upon dilution e.g., upon addition to the rinse cycle of a laundry process.

Other cationic materials with ring structures such as alkyl imidazoline, imidazolinium, pyridine, and pyridinium salts having a single $C_{12}$–$C_{30}$ alkyl chain can also be used. Very low pH is required to stabilize, e.g., imidazoline ring structures.

It will be understood that the main function of the cationic surfactant in these compositions (II) is to encourage deposition of softener and it is not, therefore, essential that the cationic surfactant itself have substantial softening properties, although this may be the case. Indeed, it is essential that at least a part of the cationic component of the composition comprises a surfactant having only a single long alkyl chain, as such compounds, presumably because they have greater solubility in water, can more effectively provide the appropriate positive charge distribution and the degree of hydration on the surface of the emulsified/dispersed nonionic softener particle.

Thus, it is essential that at least a portion of the cationic surfactant have a single $C_{10}$–$C_{22}$, preferably $C_{12}$–$C_{18}$, alkyl group.

Preferred cationic surfactants are the ones disclosed hereinbefore as (I)(B)(1).

Also useful in these compositions (II) are di- or polycationic materials, e.g., diquaternary ammonium salts, of the above general formula, having the formula:

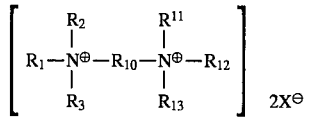

wherein group $R_1$ is $C_{12}$–$C_{20}$ fatty alkyl, preferably $C_{16}$–$C_{18}$ alkyl, groups $R_2$ and $R_3$ are each $C_1$–$C_4$ alkyl, preferably methyl, and $R_4$ is the group $R_{10}$, $R_{11}$, $R_{12}$, $R_{13}$, $N^{\oplus}$, $X^{\theta}$ wherein $R_{10}$ is $C_2$–$C_8$, preferably $C_3$–$C_4$ alkylene; $R_{11}$, $R_{12}$ and $R_{13}$ are each $C_1$–$C_4$ alkyl, preferably methyl; and X is an anion, for example, a halide. Other poly-cationic materials are the ones described in U.S. Pat. No. 4,022,938, incorporated hereinbefore by reference.

These poly-cationic, e.g., diquaternary ammonium, salts can, in certain circumstances, provide additional positive charge at the emulsion/dispersion particle surface, and thereby improve deposition.

The conventional quaternary ammonium softening agents having formulae similar to the formulae of the single-long-chain alkyl cationic surfactants, but which contain two $C_{12}$–$C_{20}$ fatty alkyl groups, function to a certain extent in the same way as the essential mono-long-chain alkyl compounds.

In many cases, it is advantageous to use a 3-component composition comprising nonionic softener, mono-long-chain alkyl cationic surfactant such as fatty acid choline ester, cetyl trimethylammonium bromide, etc., and di-long-chain alkyl cationic softener such as ditallowdimethylammonium chloride or ditallowmethyl amine salt or DEQA as described herein. The additional cationic softener, as well as providing additional softening power and improving performance of nonionic softeners which do not provide optimum performance, also acts as a reservoir of additional positive charge, so that any anionic surfactant which is carried over into the rinse solution from a conventional washing process is effectively neutralized and does not upset the positive charge distribution on the surface of the emulsified nonionic softener particles. The di-long-chain alkyl cationic softener also improves performance, the rate at which the dispersion/suspension forms, and the concentration that can be achieved in the dispersed composition.

(C) Optional Ingredients

The same optional ingredients disclosed hereinbefore for compositions (I)(D)(1–6) serve as optional ingredients for composition II.

(D) Composition Formulation (II)

The preferred particulate (granular) softener compositions (II) of the present invention preferably comprise at least 20% of the nonionic softener and at least 5% of the cationic surfactant. The level of nonionic softener is from about 20% to about 95%, preferably from about 50% to about 85%, more preferably from about 60% to about 80%. The level of essential mono-long-chain alkyl cationic surfactant is typically from about 5% to about 50%, preferably from about 10% to about 35%, more preferably from about 15% to about 30%. The ratio of nonionic softener to mono-long-chain alkyl surfactant is typically from about 12:1 to about 1:1, preferably from about 9:1 to about 2:1, more preferably from about 5:1 to about 2:1.

In one of the highly preferred embodiments of these compositions (II), substantially all (i.e., at least about 80%) of the granules comprises the above-discussed two components, namely (A) the nonionic softener and (B) one or more single-long-Chain alkyl cationic surfactants. However, the granules can include other non-interfering components, for example, other nonionic softeners and/or di-long-chain alkyl cationic, so long as the HLB of the nonionic softener mixture is within the desired limits and the overall dispersibility is maintained.

Two types of these softening compositions (II) are particularly preferred in the present invention and these will be discussed separately below.

The first type has a substantially two-component formula in which from about 50% to about 95%, preferably from about 65% to about 80%, of nonionic softener, preferably sorbitan ester, is combined with from about 5% to about 50%, preferably from about 20% to about 35%, of mono-long-chain alkyl cationic surfactant, preferably one of the formula $R_1R_2R_3R_4N^{\oplus}X^{\theta}$ wherein $R_1$ is $C_{12}$–$C_{30}$ alkyl containing an optional ester or amide linkage, $R_2$, $R_3$ and $R_4$ are each H, $C_1$–$C_4$ alkyl or hydroxyalkyl, preferably methyl, and X is an anion, preferably chloride, bromide or methyl sulfate.

These compositions (II) of the above type provide very effective softening compositions at relatively low levels of cationic surfactants, and these compositions are therefore especially preferred.

The second type of preferred composition employs a three-component mixture comprising nonionic softener, preferably sorbitan ester, cationic surfactant having a single long alkyl chain and cationic surfactant having two long alkyl chains, especially DEQA. Preferred mono-long-chain alkyl cationic surfactants are choline, esters of fatty alcohols containing from about 10 to about 22, preferably from about 12 to about 18, carbon atoms; $C_{12}$–$C_{22}$ (preferably $C_{16}$–$C_{18}$) alkyl trimethylammonium chlorides, bromides, methyl sulfates, etc. Varisoft® 110, 222, 445 and 475; Adogen® 442 and 470; ditallowalkylmethyl amine; and (bis-$C_{16}$–$C_{18}$ alkyl carboxymethyl)methyl amine are preferred di-long-chain alkyl cationic surfactants. Preferred compositions of this type comprise from about 20% to about 80%, preferably from about 50% to about 75%, of nonionic; from about 5% to about 30%, preferably from about 15% to about 25%, of mono-long-chain alkyl cationic; and from about 10% to about 65%, preferably from about 15% to about 40%, of di-long-chain alkyl cationic surfactant.

In the case of the three-component mixture, it is more preferred, when forming the granules, to pre-mix the nonionic Softener and the more soluble (i.e., single alkyl chain) cationic compound before mixing in a melt of the di- alkyl cationic compound. This procedure leads to granules that provide an aqueous emulsion having particles of very low average size, the particles being positively charged at their surface. Depending upon the particular selection of nonionic softener and cationic surfactant, it may be necessary in certain cases to include other emulsifying ingredients (e.g., common ethoxylated alcohol nonionics).

The granules can be formed by preparing a melt, solidifying it by cooling, and then grinding and sieving to the desired size. It is highly preferred that the particles of the granules have a diameter of from about 50 to about 1,000, preferably from about 50 to about 400, more preferably from about 50 to about 200, microns. The granules may comprise smaller and larger particles, but preferably from about 85% to about 95%, more preferably from about 95% to about 100%, are within the indicated ranges. Smaller and larger particles do not provide optimum emulsions/dispersions when added to water.

Other methods of preparing granules can be used including spray cooling.

The flowability of the granules can be improved by treating the surface of the granules with flow improvers such as clay, silica or zeolite particles, water-soluble inorganic salts, starch, etc.

All percentages, ratios, and parts herein are by weight unless otherwise specified. All numbers in limits, ratios and numerical ranges, etc., herein are approximate, unless otherwise specified.

The following exemplifies some of the preferred particulate fabric softening compositions used in the method of the present invention and the benefits obtained by using such compositions.

| | EXAMPLE: | | |
|---|---|---|---|
| | I | II | III |
| | (Wt. % of Solid Composition) | | |
| Cetyltrimethylammonium Bromide (CTAB) | 22.9 | — | — |
| Lauroylcholine Chloride (LCC) | — | 17 | — |
| Myristoylcholine Chloride (MCC) | — | — | 17 |
| Sorbitan Monostearate (SMS) | 68.2 | — | — |
| Glycerol Monostearate (GMS) | — | — | 50 |
| Sucrose Distearate (SuDS) | — | 50 | — |
| Ditallowalkylmethyl Amine | — | 33 | 33 |
| Perfume | 3.3 | | |
| Porous Silica | 5.7 | | |

| | EXAMPLE: | | |
|---|---|---|---|
| | IV | V | VI |
| | (Wt. % of Solid Composition) | | |
| Lauroylcholine Chloride (LCC) | 25 | — | 6.26 |
| Tallowcholine Chloride (TCC) | — | — | 18.75 |
| Cetylpyridinium Chloride | — | 25 | — |
| Sorbitan Monostearate (SMS) | — | 75 | 75 |
| Glycerol Monostearate (GMS) | 56 | — | — |
| Triglycerol Distearate (TGDS) | 19 | — | — |

EXAMPLE PREPARATION

EXAMPLE I

A homogeneous mixture of cetyltrimethylammonium bromide (CTAB) and sorbitan monostearate (SMS) is obtained by melting SMS (82.5 g) and mixing CTAB (27.5 g) therein. The solid softener product is prepared from this "co-melt" by one of two methods: (a) cryogenic grinding (−78° C.) to form a fine powder, or (b) prilling to form 50–500 μm particles.

Cryogenic Grinding

The molten mixture is frozen in liquid nitrogen and ground in a Waring blender to a fine powder. The powder is placed in a dessicator and allowed to warm to room temperature, yielding a fine, free flowing powder (granule).

Prilling

The molten mixture (~88° C.) falls ~1.5 inches at a rate of about 65 g/min. onto a heated (~150° C.) rotating (~2,000 rpm) disc. As the molten material is spun off the disk and air cooled (as it radiates outward), near-spherical granule particles (50–500 μm) form.

The complete perfumed solid softener product of Example I is prepared by mixing the preformed "perfumed silica" described below with the above solid softener actives. Perfume is loaded onto porous silica and subsequently admixed with the powdered (or prilled) softener actives. (The "perfumed silica" is first prepared by mixing 2.1 parts porous silica into a molten premix comprised of 3 parts SMS, 1 part CTAB, and 1.2 parts perfume.) The complete perfumed softener product (Example I) is reconstituted in water as described above for the perfume-free material.

Dispensing in ADD 5.5 grams of the solid particles are dispersed in 62 grams of warm water (40° C., 890 g) in an ADD, the ADD is sealed, and the ADD is vigorously shaken for approximately 1 minute, then added to the wash basket of a conventional U.S. top loading automatic Kenmore washing machine at the start of the wash cycle. The aqueous product achieves an essentially homogeneous emulsion/dispersion during the wash cycle, and the ADD opens and releases the aqueous fabric softener composition at the start of the rinse cycle. Addition of the solid product to water in an ADD at the start of the wash cycle of a washing process provides excellent softness, substantiality, and antistatic characteristics.

EXAMPLE II 13.1 g of citric acid and 3.1 g of potassium citrate are added to 36.3 g of molten ditallowmethyl amine to form a premix. Lauroylcholine chloride (18.7) and sucrose distearate (55 g) are mixed therein to form a thick brown paste. The paste is cryogenically ground to a fine, free-flowing powder (~50–500 microns in diameter). The powdered softener granule composition is added to an ADD as described for Example I. Addition of this liquid fabric softening product to the rinse cycle of a washing process delivers softness, static control, and substantiality benefits to fabrics.

EXAMPLE III

Following the procedure outlined in Example II, 13.1 g of citric acid, 3.1 g of potassium citrate, 18.7 g of myristoylcholine, and 55 g of GMS are stirred into 36.3 g of molten ditallowmethyl amine to form a creamy white paste. The paste is cryogenically ground into a fine, free-flowing powder (~50–500 microns in diameter). A liquid dispersion of this product is prepared by adding hot (60° C., 890 g) water to the powdered softener actives in an ADD, sealing the ADD, and vigorously shaking for approximately 1 minute before adding the ADD to the wash cycle of a conventional U.S. top loading automatic washing machine. Softness, static control, and substantivity benefits are comparable to, or better than, those of Example II.

EXAMPLE IV 27.4 g of lauroylcholine is stirred into a co-melt containing 61.6 g of GMS and 21.0 g of triglycerol distearate. The mixture is cryogenically ground as described in Example I. The solid product is reconstituted in 890 g of 40° C. water in an ADD to form a liquid dispersion which delivers excellent softening and antistatic benefits to fabrics when added to the rinse cycle of a wash process.

EXAMPLES V and VI

Following the procedure of Example I, a homogeneous mixture of cetylpyridinium chloride (27.5 g) and molten SMS (82.5 g) or a mixture of LCC (6.87 g), TCC (20.69), and SMS (82.5 g) is prepared and cryogenically ground to a fine white powder (~50–500 microns in diameter). The solid softener composition readily disperses in warm (40° C.) water in an ADD to yield a liquid rinse-added fabric softener which provides excellent softness, substantivity, and static control benefits to clothes.

EXAMPLE VI

| | Solid Particulate Compositions Plus Water to Form Liquid Compositions in an ADD | | | | | | | |
|---|---|---|---|---|---|---|---|---|
| Component | 1 Wt. % | 2 Wt. % | 3 Wt. % | 4 Wt. % | 5 Wt. % | 6 Wt. % | 7 Wt. % | 8 Wt. % |
| DEQA[1] | 90.5 | 86.5 | 67 | 88.4 | 88.4 | 88.4 | 88.4 | 90.5 |
| Ethoxylated Fatty Alcohol[2] | 5.6 | 9.6 | — | 11.6 | 11.6 | 11.6 | 11.6 | — |
| PGMS [3] | — | — | 19.5 | | | | | |
| Coconut Choline Ester Chloride | — | — | 9.6 | | | | — | 5.6 |
| Minors (Perfume; Antifoam) | 3.9 | 3.9 | 3.9 | | | | — | 3.9 |
| Electrolyte | | | | | | | — | — |

[1]Di(tallowoyloxyethyl)dimethyl ammonium chloride.
[2]1 and 2 are $C_{16}$–$C_{18}$ $E_{18}$;
4 is $C_{16}$–$C_{18}$ $E_{11}$;
5 is $C_{16}$–$C_{18}$ $E_{18}$;
6 is $C_{16}$–$C_{18}$ $E_{50}$; and
7 is $C_{10}$ $E_{11}$.
[3]Polyglycerol monostearate having a trade name of Radiasurf 7248.

The above compositions were made by the procedure given below.

Procedure

Molten DEQA is mixed with molten ethoxylated fatty alcohol or molten coconut choline ester chloride. In No. 3, molten PGMS is also added. The mixture is cooled and solidified by pouring onto a metal plate, and then ground. The solvent is removed by a Rotovapor® (2 hrs. at 40°–50° C. at maximum vacuum). The resulting powder is ground and sieved. Separately, a co-melt of the softening active and perfume is made. The co-melt is adsorbed on porous silica while keeping the temperature at about 50° C. to keep the co-melt liquid. By adding the co-melt in portions to the preheated porous silica under agitation or by spraying the co-melt on preheated porous silica in a "Nauta" mixer, adsorption is achieved.

The resulting free-flowing powder is cooled to a temperature ranging from 3° C. to ambient, and sieved on an appropriate sieve (e.g., Mesh 22). The powder is then agglomerated in an agglomeration unit, such as a Plough Share Lodige, possibly with the addition of a coating/agglomeration material. The agglomerate is cooled and sieved over an appropriate sieve (e.g., Mesh 22). The two powders are thoroughly admixed.

From about 2 gms to about 20 gms of the resulting solid product above are mixed with from about 20 cc to about 100 cc of water at 35° C. in an ADD to form a liquid dispersion which delivers excellent softening benefits to fabrics when released to the rinse cycle of a wash process.

What is claimed is:

1. A method of conditioning fabrics wire an emulsion/dispersion fabric softener composition during the rinse cycle of a typical wash process comprising a wash cycle and at least one rinse cycle comprising the following steps:

I. adding from about 2 gms to about 20 gms of a particulate fabric softener composition to an automatic dosing dispenser, having an automatic dispenser valve which seals the dispenser during the wash cycle and opens the dispenser during the rinse cycle, with from about 20 cc to about 100 cc of water at a temperature of from about 20° C. to about 90° C.;

said fabric softener particulate composition comprising:

A. from about 50% to about 95% of biodegradable diester quaternary ammonium fabric softening compound selected from the group consisting of: those having the formula:

(a)

$$(R)_{4-m}—N^+—[(CH_2)_n—Y—R^2]_m\ X^-$$

wherein each Y= —(O)—C—, or —C(O)—O—;

m=2 or 3;

each n=1 to 4;

each R substituent is a short chain $C_1$–$C_6$ alkyl or hydroxyalkyl group; each $R^2$ is a long chain $C_{12}$–$C_{22}$ hydrocarbyl, or substituted hydrocarbyl, substituent; and the counterion, $X^-$ is any softener-compatible anion; those having the formula:

(b)

$$R^2C(O)OCH_2[R^2C(O)O]CHCH_2N^+R_3\ X^-$$

wherein each R, $R^2$, and X have the same meanings as before; and (c) mixtures thereof; and (B) from about 3% to about 30% of viscosity modifier, dispersibility modifier, or viscosity and dispersibility modifier, selected from the group consisting of:

1. single-long-chain-alkyl, cationic suffactant;
2. nonionic surfactant with at least 8 ethoxy moieties; and
3. mixtures thereof;

and wherein said biodegradable diester quaternary ammonium fabric softening compound is at least 80% diester; wherein the ratio of (A) to (B) is from about 15:1 to about 2:1; and wherein the particle size is from about 50 to about 1000 microns; and II. seating the automatic dosing dispenser valve to seal the dispenser; and III. placing the automatic dosing dispenser into a conventional automatic washing machine basket; whereby the mechanical agitation of the wash cycle forms an aqueous emulsion/dispersion of the composition which is released during the rinse cycle.

2. The method of claim 1 wherein from about 4 gms to about 10 gms of a particulate fabric softener composition is added to the ADD.

3. The method of claim 1 wherein the particulate fabric softener composition is added to the ADD prior to the water, whereby any particulate which deposits on the ADD seal valve will be washed down into the ADD with the addition of the water.

4. The method of claim 1 wherein the particulate fabric softener composition is capable of forming the finely divided emulsion/dispersion within about thirty minutes when added to water at a temperature of from about 35° C. to about 45° C., with gentle agitation.

5. The method of claim 4 wherein the particulate fabric softener composition has an average particle diameter of between about 50 and about 400 microns.

6. The method of claim 1 wherein the fabric softening composition additionally comprises an effective amount, for dispersing the active ingredient, of polyglycerol monostearate nonionic fabric softener.

7. The method of claim 4 wherein the particulate fabric softener composition comprises homogeneous particles containing:

A. from about 20% to about 95% of nonionic fabric softener material; and

B. from about 5% to about 50% of cationic surfactant material that is cationic under conditions of use at dilute concentrations of the composition, the cationic surfactant material having a single long alkyl chain containing from about 12 to about 30 carbon atoms wherein said cationic surfactant material consists of quaternary ammonium salts of the general formula $R_1R_2R_3R_4^+X^-$, and the corresponding mono-long-chain alkyl unquaternized amines where groups $R_1$, $R_2$, $R_3$, $R_4$ consist of alkyl or substituted alkyl; and X is an anion.

8. The method of claim 4 wherein m is 2, one R is a $C_1$–$C_6$ hydroxyalkyl group and one R is a $C_1$–$C_6$ alkyl group.

9. The method of claim 4 wherein (B) is a single-long-chain-alkyl cationic surfactant at an effective level of up to about 15% of the composition.

10. The method of claim 9 wherein (B) is $C_{12}$–$C_{14}$ choline ester.

11. The method of claim 4 wherein (B) is a bimodal mixture of choline ester where one has a long chain of about 12 carbon atoms and one has a long chain of about 18 carbon atoms.

12. The method of claim 4 wherein (B) is a nonionic surfactant at an effective level of up to about 20% of the composition.

13. The method of claim 12 wherein (B) is $C_{10-14}$ alcohol with poly(10-18)ethoxylate.

14. The method of claim 1 which additionally comprises an effective amount, up to 10%, of a soil release polymer which provides improved stability to the composition wherein said soil release polymer includes copolymeric blocks of terephthalate and polyethylene oxide or polypropylene oxide.

15. The method of claim 1 wherein each R is a methyl group and each $R^2$ is a $C_{16}$–$C_{18}$ alkyl group.

16. The method of claim 1 wherein (B) is a single-long-chain-alkyl cationic surfactant at an effective level of up to about 15% of the composition.

17. The method of claim 16 wherein (B) is $C_{12}$–$C_{14}$ choline ester.

18. The method of claim 1 wherein (B) is a nonionic surfactant at an effective level of up to about 20% of the composition.

19. The method of claim 18 wherein (B) is $C_{10}$–$C_{14}$ alcohol with poly(10-18)ethoxyl ate.

20. The method of claim 1 which additionally comprises an effective amount, up to 10%, of a soil release polymer which provides improved stability to the composition wherein said soil release polymer includes copolymeric blocks of terephthalate and polyethylene oxide or polypropylene oxide.

21. The method of claim 1 wherein the solid particulate composition additionally contains at least one ingredient selected from the group consisting of: from about 0.05% to about 5% inorganic electrolyte, from about 0.3% to about 3% of soil release polymer containing copolymeric blocks of terephthalate and polyethylene oxide or polypropylene oxide, an effective amount of perfume, dye, antifoam, flow aid, or mixtures thereof, to improve the stability of the resulting compositions.

22. The method of claim 1 wherein the fabric softening composition additionally comprises, for static control, and effective amount of up to about 47% of a di-substituted midazoline softening compound of the formula:

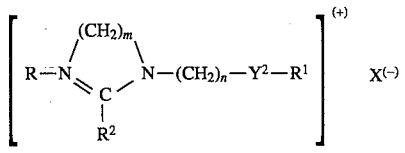

(I)

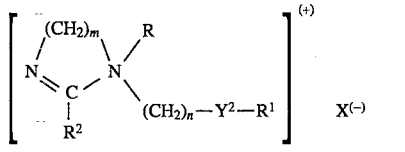

(II)

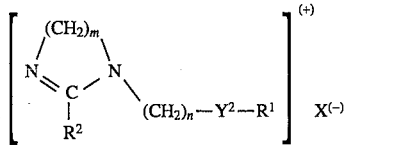

(III)

or mixtures thereof, wherein $Y^2$ is —C(O)—O—, —O—(O)—C—, —C(O)—N($R^5$), or —N($R^5$)—C(O)—, in which $R^5$ is hydrogen or a $C_1$–$C_4$ alkyl radical; $R^1$ and $R^2$ are, independently, a $C_{11}$–$C_{21}$ hydrocarbyl group; R is a $C_1$–$C_4$ hydrocarbyl group; m and n are, independently, from about 2 to about 4; and X(⁻) is any softener compatible anion.

23. The method of claim 1 wherein the particulate fabric softening composition comprises:

(A) from about 60% to about 90% of biodegradable diester quaternary ammonium fabric softening compound, selected from the group having the formula:

$$(R)_{4-m}—N^{\oplus}—[(CH_2)_n—Y—R^2]_m\ X^{\ominus}$$

wherein each Y=—O—(O)C—, or —C(O)—O—;

m=2 or 3;

each n=1 to 4;

each R substituent is a short chain $C_1$–$C_6$ alkyl or hydroxyalkyl group;

each $R^2$ is a long chain $C_{12}$–$C_{22}$ hydrocarbyl, or alkoxyl or hydroxyl substituted hydrocarbyl substituent; and the counterion $X(^-)$, can be any softener-compatible anion:

(B) from about 3% to about 30% of modifier for viscosity, dispersibility, or mixtures thereof, selected from the group consisting of:

1. single-long-chain-alkyl, cationic surfactant;
2. nonionic surfactant with at least 8 ethoxy moieties; or
3. mixtures thereof;

wherein the ratio of(A) to (B) is from about 15:1 to about 2:1; and the particle size is from about 50 to about 1,000 microns.

24. The method of claim 1 wherein the fabric softening composition comprises:

(A) from about 60% to about 90% of diester quaternary ammonium fabric softening compound having the formula:

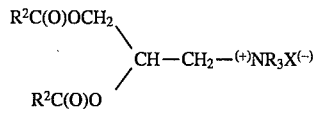

wherein each R is a $C_1$–$C_4$ alkyl, hydroxy alkyl, benzyl group, or mixtures thereof:

each $R^2$ is a $C_{11}$–$C_{22}$ alkyl group; and $X^-$ is any water soluble anion; and (B) from about 3% to about 30% of modifier for viscosity, dispersibility, or mixtures thereof, selected from the group consisting of:

1. single-long-chain-alkyl, cationic surfactant;
2. nonionic surfactant with at least 8 ethoxy moieties; or
3. mixtures thereof:

wherein the ratio of (A) to (B) is from about 15:1 to about 2:1; and the particle size is from about 50 to about 1,000 microns.

* * * * *